US012529526B2

(12) United States Patent
Fukuda

(10) Patent No.: US 12,529,526 B2
(45) Date of Patent: Jan. 20, 2026

(54) THERMAL DIFFUSION DEVICE AND ELECTRONIC APPARATUS

(71) Applicant: Murata Manufacturing Co., Ltd., Nagaokakyo (JP)

(72) Inventor: Hiroshi Fukuda, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 168 days.

(21) Appl. No.: 18/470,605

(22) Filed: Sep. 20, 2023

(65) Prior Publication Data

US 2024/0011718 A1 Jan. 11, 2024

Related U.S. Application Data

(63) Continuation of application No. PCT/JP2022/004717, filed on Feb. 7, 2022.

(30) Foreign Application Priority Data

Mar. 23, 2021 (JP) ..... 2021-048946

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... F28D 15/046; F28D 15/04; F28D 15/0233
See application file for complete search history.

(56) References Cited

U.S. PATENT DOCUMENTS 3,680,189 A * 8/1972 Noren ..... F28D 15/0283 29/890.032
6,437,437 B1 * 8/2002 Zuo ..... H01L 23/427 257/710

(Continued)

FOREIGN PATENT DOCUMENTS

CN 211234063 U 8/2020
JP 2000074581 A * 3/2000 ..... F28D 15/046

(Continued)

OTHER PUBLICATIONS

International Search Report in PCT/JP2022/004717, mailed Mar. 29, 2022, 4 pages.

*Primary Examiner* — Tho V Duong
(74) *Attorney, Agent, or Firm* — ArentFox Schiff LLP

(57) ABSTRACT

A thermal diffusion device that includes: a housing including a first inner wall surface and a second inner wall surface opposed to each other in a thickness direction; a working medium in an internal space of the housing; a porous body between the first inner wall surface and the second inner wall surface; and a support inside the housing along a direction of extension of the porous body and configured to support the first inner wall surface of the housing and the porous body. The support is positioned such that a liquid passage for the working medium is defined in a space surrounded by the porous body and the first inner wall surface. In plan view of the housing, a region where the first inner wall surface overlaps the porous body is smaller than a region where the first inner wall surface does not overlap the porous body.

19 Claims, 6 Drawing Sheets

(56) References Cited

U.S. PATENT DOCUMENTS

| | | | | |
|---|---|---|---|---|
| 2011/0315351 | A1* | 12/2011 | Meyer, IV | F28D 15/0233 165/104.26 |
| 2014/0166244 | A1* | 6/2014 | Dai | F28D 15/0233 29/890.032 |
| 2017/0350657 | A1 | 12/2017 | Yeh et al. | |
| 2020/0003499 | A1* | 1/2020 | Kume | F28D 15/046 |
| 2021/0356211 | A1* | 11/2021 | Naito | F28D 15/0233 |

FOREIGN PATENT DOCUMENTS

| | | | |
|---|---|---|---|
| JP | 3206206 | U | 9/2016 |
| JP | 2018004108 | A | 1/2018 |
| JP | 2018076989 | A | 5/2018 |
| WO | 2019065864 | A1 | 4/2019 |

* cited by examiner

THERMAL DIFFUSION DEVICE AND ELECTRONIC APPARATUS

CROSS REFERENCE TO RELATED APPLICATIONS

The present application is a continuation of International application No. PCT/JP2022/004717, filed Feb. 7, 2022, which claims priority to Japanese Patent Application No. 2021-048946, filed Mar. 23, 2021, the entire contents of each of which are incorporated herein by reference.

TECHNICAL FIELD

The present invention relates to a thermal diffusion device and an electronic apparatus.

BACKGROUND ART

An amount of heat generated by a device has been increasing in recent years along with higher integration and higher performances thereof. Meanwhile, progress in size reduction of a product increases a heat generation density, and a countermeasure for heat dissipation is therefore important. This situation is particularly prominent in the field of mobile terminals such as smartphones and tablets. A graphite sheet or the like is frequently used as a member for a countermeasure against the heat. However, an amount of heat transport thereof is insufficient and use of various members for the countermeasure against the heat have therefore been in review. Among them, a review is in progress to use a vapor chamber, which is a planar heat pipe, as a thermal diffusion device capable of diffusing heat very effectively.

The vapor chamber has a structure in which a working medium (also referred to as a working fluid) and a wick for transporting the working medium by using capillary force are enclosed inside a housing. The working medium absorbs heat from a heat generating element such as an electronic component at an evaporation portion that absorbs the heat from the heat generating element. After evaporation inside the vapor chamber, the working medium moves inside the vapor chamber, and is cooled down and returns to a liquid phase. The working medium having returned to the liquid phase moves again to the evaporation portion on the heat generating element side by the capillary force of the wick, and cools down the heat generating element. By repeating this operation, the vapor chamber can operate autonomously without being provided with external drive force, and diffuse the heat two-dimensionally at a high speed by using latent heat of evaporation and latent heat of condensation of the working medium.

Patent Document 1 discloses a heat pipe including a flat container in which a working fluid is enclosed, and a wick provided inside the container. The wick includes a braid body made by cylindrically braiding fibers, and a linear bundle made by linearly bundling fibers thicker than the former fibers. The linear bundle is arranged in a hollow part surrounded by an inner peripheral surface of the braid body. Moreover, a vapor passage for the working fluid is formed around the braid body, and a liquid passage for the working fluid is formed in the hollow part.

Patent Document 1: Japanese Unexamined Patent Application Publication No. 2018-76989

SUMMARY OF THE INVENTION

According to the heat pipe described in Patent Document 1, an internal region and an external region are provided to the wick by changing the thickness of the fibers used as the materials of the wick, and then the internal region is used as the liquid passage while the external region is used as the vapor passage.

However, when the wick in the vapor chamber is formed from the fibers, capillary force and a transmission ratio of the wick have a trade-off relation. Accordingly, it is difficult to obtain a sufficient liquid transport performance.

Note that the aforementioned problem is not limited to the vapor chamber but is a common problem to thermal diffusion devices that can diffuse the heat with the configuration similar to that of the vapor chamber.

An object of the present invention is to provide a thermal diffusion device that is excellent in a liquid transport performance. Moreover, another object of the present invention is to provide an electronic apparatus that includes the above-described thermal diffusion device.

A thermal diffusion device of the present invention includes: a housing including a first inner wall surface and a second inner wall surface opposed to each other in a thickness direction of the housing; a working medium sealed in an internal space of the housing; a porous body having a sheet-like shape between the first inner wall surface and the second inner wall surface of the housing; and a support inside the housing along a direction of extension of the porous body and configured to support the first inner wall surface of the housing and at least a portion of the porous body, the support being positioned such that the porous body is between the support and the second inner wall surface of the housing and a liquid passage for the working medium is defined in a space surrounded by the porous body and the first inner wall surface. In a plan view of the housing in the thickness direction, a region where the first inner wall surface overlaps the porous body is smaller than a region where the first inner wall surface does not overlap the porous body.

An electronic apparatus of the present invention includes the thermal diffusion device of the present invention.

According to the present invention, it is possible to provide a thermal diffusion device that is excellent in a liquid transport performance. Moreover, according to the present invention, it is possible to provide an electronic apparatus that includes the above-described thermal diffusion device.

DETAILED DESCRIPTION OF THE PREFERRED EMBODIMENTS

A thermal diffusion device of the present invention will be described below.

It is to be noted, however, that the present invention is not limited to the following embodiments, and appropriate changes are applicable thereto within a range not changing the gist of the present invention. The present invention also encompasses a combination of two or more preferable configurations of the present invention to be described below.

The respective embodiments shown below are mere examples. Needless to say, it is possible to partially replace or combine configurations described in different embodiments. In a second embodiment and so forth, a description regarding items that are common to a first embodiment will be omitted and the description will be given only of different features. In particular, the same operations and effects as those brought about by the same configuration will not be mentioned each time in every embodiment.

In the following description, a simple expression of a "thermal diffusion device of the present invention" will be used when it is not particularly necessary to distinguish between the respective embodiments.

In the following, a vapor chamber will be described as an example of an embodiment of the thermal diffusion device of the present invention. The thermal diffusion device of the present invention is also applicable to other thermal diffusion devices such as a heat pipe.

The drawings shown below are merely schematic and, for example, dimensions and scales such as aspect ratios thereof may be different from those of actual products.

First Embodiment

In a first embodiment of the present invention, a vapor passage for a working medium is formed between a porous body and a second inner wall surface.

Figure 1:
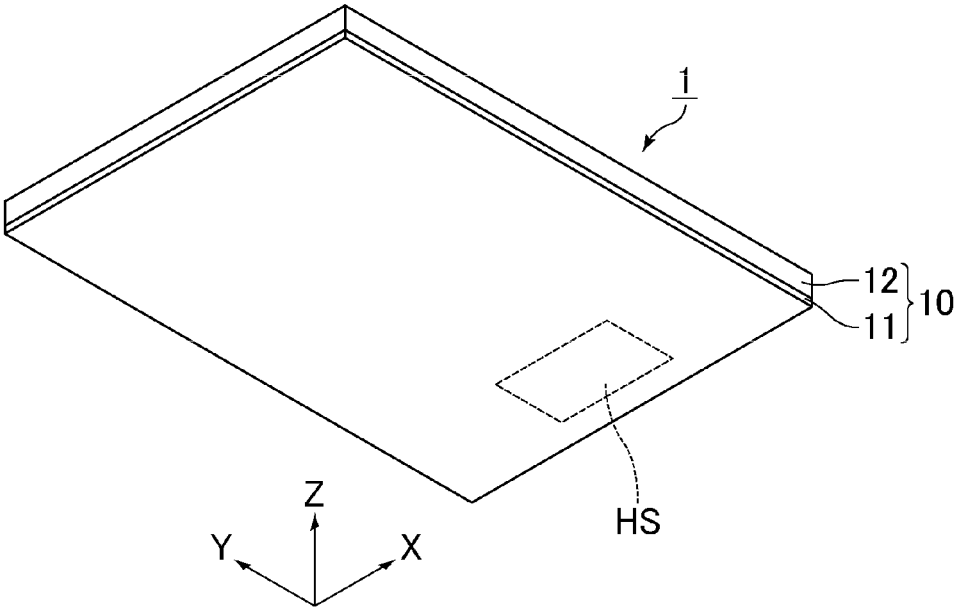
FIG. 1 is a perspective view schematically showing an example of a thermal diffusion device according to a first embodiment of the present invention.
Figure 2:
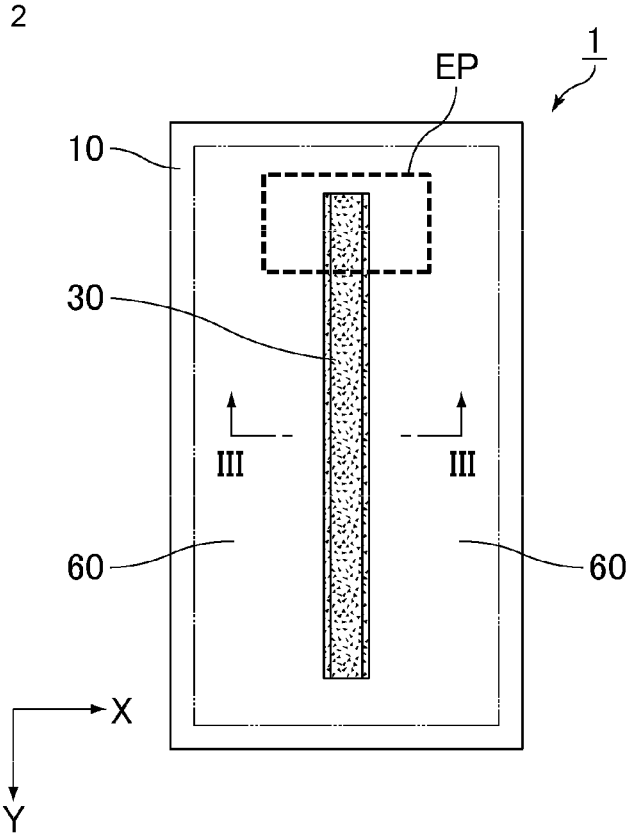
FIG. 2 is a plan view schematically showing an example of an internal structure of the thermal diffusion device shown in FIG. 1.
Figure 3:
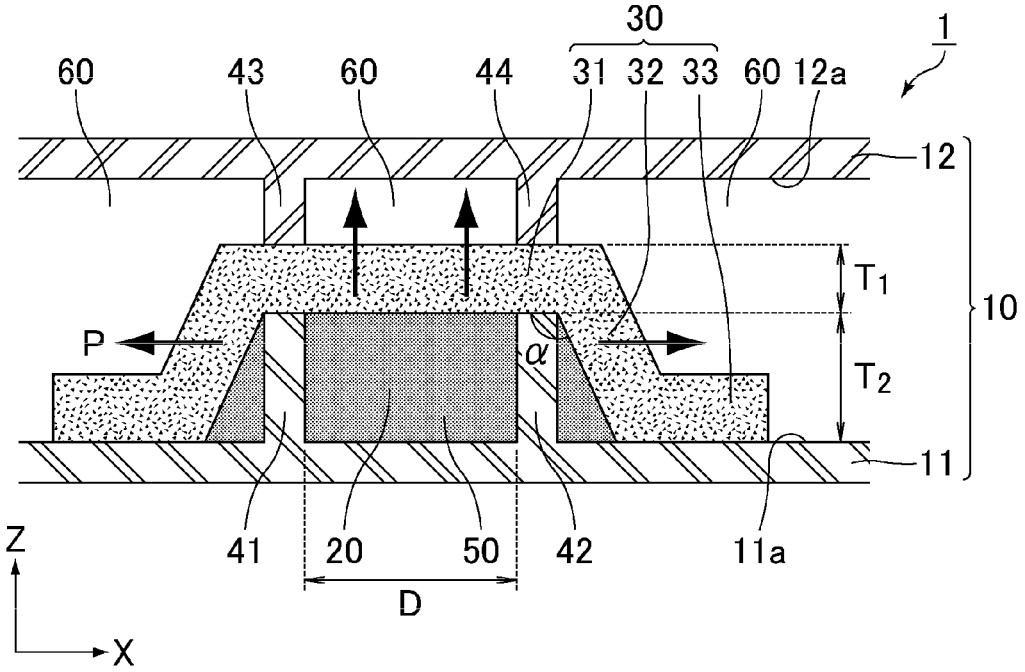
FIG. 3 is a cross-sectional view of the thermal diffusion device shown in FIG. 2, which is taken along the III-III line.

FIG. 1 is a perspective view schematically showing an example of a thermal diffusion device according to a first embodiment of the present invention. FIG. 2 is a plan view schematically showing an example of an internal structure of the thermal diffusion device shown in FIG. 1. FIG. 3 is a cross-sectional view of the thermal diffusion device shown in FIG. 2, which is taken along the III-III line.

A vapor chamber 1 shown in FIG. 1 includes a hollow housing 10 hermetically sealed in an airtight state. As shown in FIG. 2, an evaporation portion EP to evaporate a sealed working medium 20 (see FIG. 3) is set to the housing 10. As shown in FIG. 1, a heat source HS being a heat generating element is disposed at an outer wall surface of the housing 10. Examples of the heat source HS include electronic components of an electronic apparatus such as a central processing unit (CPU). Of an internal space of the housing 10, a portion located near the heat source HS and heated by the heat source HS corresponds to the evaporation portion EP.

As shown in FIG. 3, the housing 10 includes a first inner wall surface 11*a* and a second inner wall surface 12*a*, which are opposed to each other in a thickness direction Z. The housing 10 is preferably formed from a first sheet 11 and a second sheet 12 opposed to each other and provided with outer rim portions joined to each other.

The vapor chamber 1 is of a planar shape as a whole. In other words, the housing 10 is of a planar shape as a whole. Here, the "planar shape" includes a plate-like shape and a sheet-like shape, and means a shape with a dimension in a width direction X (hereinafter referred to as a width) and a dimension in a length direction Y (hereinafter referred to as a length) being substantially larger than a dimension in the thickness direction Z (hereinafter referred to as a thickness or a height), such as a shape with the width and the length each being ten times or more, or more preferably, a hundred times or more than the thickness.

The size of the vapor chamber 1, that is, the size of the housing 10 is not limited to a particular size. The width and the length of the vapor chamber 1 can be set as appropriate depending on intended use. Each of the width and the length of the vapor chamber 1 is set equal to or above 5 mm and equal to or below 500 mm, equal to or above 20 mm and equal to or below 300 mm, or equal to or above 50 mm and equal to or below 200 mm, for example. The width and the length of the vapor chamber 1 may be equal to or different from each other.

When the housing 10 is formed from the first sheet 11 and the second sheet 12, a material constituting the first sheet 11 and the second sheet 12 is not limited to a particular material as long as the material has characteristics such as heat conductivity, strength, ductility, and flexibility, which are suitable for use as the vapor chamber. The material constituting the first sheet 11 and the second sheet 12 is preferably a metal such as copper, nickel, aluminum, magnesium, titanium, iron, and an alloy containing any of these metals as a main component. Copper is particularly preferable among them. The material constituting the first sheet 11 may be the same as or different from the material constituting the second sheet 12. However, the materials are preferably the same.

When the housing 10 is formed from the first sheet 11 and the second sheet 12, outer rim portions of the first sheet 11 and the second sheet 12 are joined to each other. The joining method herein is not limited to a particular method. However, it is possible to use laser welding, resistance welding, diffusion joining, brazing, tungsten inert gas welding (TIG welding), ultrasonic welding, or resin sealing, for example. Any of laser welding, resistance welding, and brazing can be preferably used.

A thickness of each of the first sheet 11 and the second sheet 12 is not limited to a particular thickness. However, each sheet is set preferably equal to or above 10 μm and equal to or below 200 μm, more preferably equal to or above 30 μm and equal to or below 100 μm, or even more preferably equal to or above 40 μm and equal to or below 60 μm. The thickness of the first sheet 11 may be equal to or different from the thickness of the second sheet 12. Moreover, the thickness of each of the first sheet 11 and the second sheet 12 may be equal across the board or partially thinner.

A shape of each of the first sheet 11 and the second sheet 12 is not limited to a particular shape. For example, the first sheet 11 may have a flat plate shape with the constant thickness while the second sheet 12 may have a shape in which the outer rim portion is thicker than the portion other than the outer rim portion.

Alternatively, the first sheet 11 may have the flat plate shape with the constant thickness while the second sheet 12 may have a shape with a constant thickness and formed into such a shape that a portion other than the outer rim portion projects outward from the outer rim portion. In this case, a recess is formed at the outer rim portion of the housing 10. Accordingly, the recess at the outer rim portion can be used for mounting the vapor chamber and the like. Meanwhile, another component and the like can be disposed at the recess at the outer rim portion.

Although the thickness of the entire vapor chamber 1 is not limited to a particular thickness, the thickness is preferably equal to or above 50 μm and equal to or below 500 μm.

A planar shape of the housing 10 viewed in the thickness direction Z is not limited to a particular shape. Examples of this shape include polygons such as a triangle and a rectangle, a circle, an ellipse, a shape formed by combining these shapes, and the like. Meanwhile, the planar shape of the housing 10 may be any of an L-shape, a C-shape (a horseshoe shape), a stepped shape, and the like. Moreover, the housing 10 may be provided with a through hole. The planar shape of the housing 10 may be such a shape that corresponds to usage of the vapor chamber, to a shape of a location to embed the vapor chamber, or to another component that is present in the vicinity thereof.

As shown in FIG. 3, the working medium 20 is sealed in the internal space of the housing 10 of the vapor chamber 1.

The working medium 20 is not limited to a particular material as long as the working medium 20 can bring about a gas-to-liquid phase change under an environment inside the housing 10. For example, water, alcohols, alternatives for chlorofluorocarbon, and the like are applicable to the working medium 20. The working medium is an aqueous compound and is preferably water, for example.

A porous body 30 in a sheet-like shape is disposed between the first inner wall surface 11*a* and the second inner wall surface 12*a* of the housing 10.

The porous body 30 functions as a wick that transports the working medium 20 by using capillary force. In FIG. 3, directions of the capillary force to be developed by the porous body 30 are indicated with arrows P.

The porous body 30 is formed from a metal porous body, a ceramic porous body, or a resin porous body, for example. The porous body 30 may be any of a metallic porous membrane formed by etching or metallic processing, a mesh, an unwoven fabric, a sintered body, for example. The mesh serving as the material of the porous body 30 may be formed from a metallic mesh, a resin mesh, or any of these meshes subjected to surface coating, for example. Preferably, the mesh is formed from a copper mesh, a stainless steel (SUS) mesh, or a polyester mesh. The sintered body serving as the material of the porous body 30 may be formed from a metallic porous sintered body or a ceramic porous sintered body, for example. Preferably, the sintered body is formed from a porous sintered body of copper or nickel.

Moreover, supports 41 and 42 are disposed in a direction of extension (which is the length direction Y here) of the porous body 30 in the housing 10. In the example shown in FIG. 3, two rows of the supports 41 and 42 are disposed parallel to each other in the direction of extension of the porous body 30. Instead, one row of the support may be disposed in the direction of extension of the porous body 30, or three or more rows of the supports may be disposed parallel to one another in the direction of extension of the porous body 30.

The supports 41 and 42 support the first inner wall surface 11*a* of the housing 10 and the porous body 30. The porous body 30 is disposed between the second inner wall surface 12*a* and the set of the supports 41 and 42.

When the housing 10 is viewed in the thickness direction Z as shown in FIG. 2, a region where the first inner wall surface 11*a* overlaps the porous body 30 is smaller than a region where the first inner wall surface 11*a* does not overlap the porous body 30.

As shown in FIG. 3, a liquid passage 50 for the working medium 20 is formed in a space surrounded by the porous body 30 and the first inner wall surface 11*a*. In the meantime, a vapor passage 60 for the working medium 20 is formed in a gap other than the liquid passage 50 in the housing 10.

Figure 4:
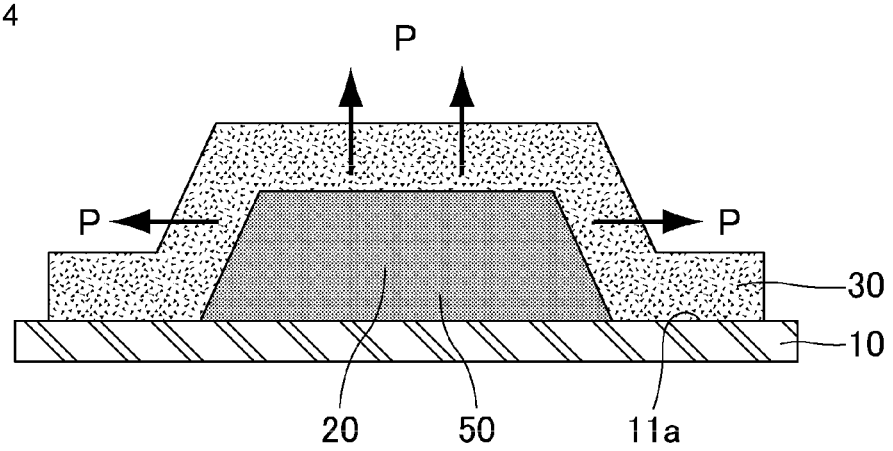
FIG. 4 is a cross-sectional view schematically showing an example of a liquid passage in the thermal diffusion device of the present invention.
Figure 5:
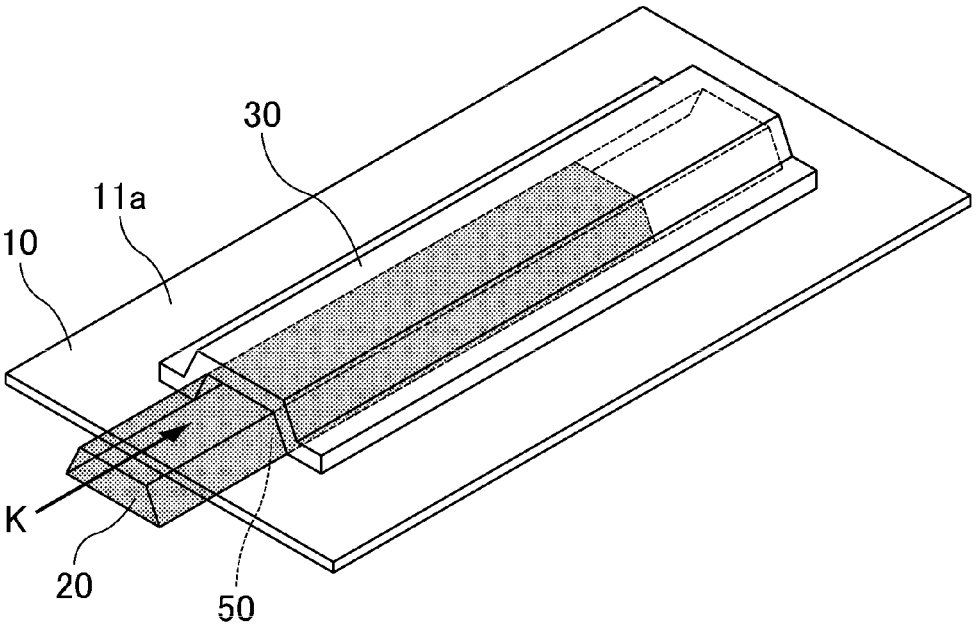
FIG. 5 is a perspective view schematically showing the example of the liquid passage in the thermal diffusion device of the present invention.

FIG. 4 is a cross-sectional view schematically showing an example of the liquid passage in the thermal diffusion device of the present invention. FIG. 5 is a perspective view schematically showing the example of the liquid passage in the thermal diffusion device of the present invention. Note that illustration of the supports 41 and 42 to support the porous body 30 is omitted in FIGS. 4 and 5.

In the thermal diffusion device such as the vapor chamber, the working medium in the liquid phase is generally transported while passing the inside of the wick. When the wick is formed from the bundle of fibers as disclosed in Patent Document 1, for example, an increase in capillary pressure by forming the inside of the wick into a dense structure is considered as a method of increasing a performance to transfer the liquid to the evaporation portion. However, when the inside of the wick is formed into the dense structure, resistance against the fluid passing the inside of the wick is increased and a transmission ratio is therefore reduced. Hence, the liquid transport performance is deteriorated accordingly. Meanwhile, as the thickness of the wick becomes smaller along with lowering the profile of the thermal diffusion device, it is more difficult to secure a volume of the liquid passage and to reduce fluid resistance.

On the other hand, according to the thermal diffusion device of the present invention, the sheet-like porous body 30 functioning as the wick surrounds the supports 41 and 42 (see FIG. 3), whereby a hollow serving as the liquid passage 50 for the working medium 20 is formed in the space surrounded by the porous body 30 and the first inner wall surface 11*a* of the housing 10 as shown in FIGS. 3, 4, and 5. According to this configuration, it is possible to develop a capillary pressure (the arrows P in FIGS. 3 and 4) with the porous body 30 around the hollow to begin with. Moreover, the working medium 20 can smoothly flow inside the hollow along with reduction in resistance against the fluid that passes the inside of the hollow, so that the transmission ratio (an arrow K in FIG. 5) can be increased. As a consequence, the performance to transport the liquid to the evaporation portion EP is increased. In the meantime, even when the thickness of the porous body 30 is small along with lowering the profile of the thermal diffusion device, the liquid passage 50 is less likely to be crushed since the porous body 30 is supported like a tent by using the supports 41 and 42. Thus, it is possible to secure the volume of the liquid passage 50.

As shown in FIG. 3, the porous body 30 preferably includes a first region 31 located away from the first inner wall surface 11*a* by way of the supports 41 and 42, and second regions 32 each being continuous with the first region 31 with its end portion being in contact with first inner wall surface 11*a*. Since the porous body 30 has the above-described configuration, the wick is formed on each side surface of the liquid passage 50. Accordingly, it is possible to increase a surface area of the wick at a boundary between the liquid passage 50 and the vapor passage 60. Here, the porous body 30 further includes third regions 33 each being continuous with the second region 32 and entirely in contact with the first inner wall surface 11*a* in the example shown in FIG. 3. However, the porous body 30 does not always have to include the third regions 33.

When a thickness of the first region 31 of the porous body 30 is defined as $T_1$ and a height of the support 41 or 42 that supports the first inner wall surface 11*a* of the housing 10 and the porous body 30 is defined as $T_2$ in the cross-section perpendicular to the direction of extension of the porous body 30 as shown in FIG. 3, a ratio $T_2/T_1$ is not limited to a particular value but is preferably equal to or above 1. As described above, by adopting the structure to support the porous body 30 with the supports 41 and 42, it is possible to secure the volume of the liquid passage 50 even when the thickness of the porous body 30 is small. Meanwhile, the ratio $T_2/T_1$ is equal to or below 4, for example.

Here, when the thickness of the first region 31 of the porous body 30 varies in the width direction X in the above-mentioned cross-section, the thickness at the thickest portion will be defined as $T_1$. Meanwhile, when the height of the support 41 is different from the height of the support 42, the height at the highest portion will be defined as $T_2$.

When an interval between the support 41 and the support 42 is defined as D in the cross-section perpendicular to the direction of extension of the porous body 30 as shown in FIG. 3, a ratio $D/T_2$ is not limited to a particular value but is preferably equal to or above 1 and equal to or below 5, for example.

The interval D between the support 41 and the support 42 in the cross-section perpendicular to the direction of extension of the porous body 30 is not limited to a particular value but is preferably equal to or above 500 μm and equal to or below 3000 μm, for example.

Here, when the interval between the support 41 and the support 42 varies in the thickness direction Z in the above-mentioned cross-section, the interval at the widest portion will be defined as D.

Preferably, the vapor chamber 1 shown in FIG. 3 further includes supports 43 and 44. In the example shown in FIG. 3, two rows of the supports 43 and 44 are disposed parallel to each other in the direction of extension of the porous body 30. Instead, one row of the support may be disposed in the direction of extension of the porous body 30, or three or more rows of the supports may be disposed parallel to one another in the direction of extension of the porous body 30. The support 43 is preferably opposed to the support 41, and the support 44 is preferably opposed to the support 42.

The supports 43 and 44 support the second inner wall surface 12*a* of the housing 10 and the porous body 30. As a consequence, the vapor passage 60 for the working medium 20 is formed between the first region 31 of the porous body 30 and the second inner wall surface 12*a*. The vapor passage 60 is less likely to be crushed by disposing the supports 43 and 44 between the second inner wall surface 12*a* of the housing 10 and the porous body 30. Thus, it is possible to secure the volume of the vapor passage 60.

The first region 31 and the second region 32 of the porous body 30 can be formed by subjecting the sheet-like porous body 30 to presswork, for example. The same applies to the case where the porous body 30 includes the third regions 33, and the third regions 33 can be formed by the presswork.

An end portion of the second region 32 of the porous body 30 is preferably fixed to the first inner wall surface 11*a* of the housing 10. When the porous body 30 is formed from a metal, for example, the end portion of the second region 32 is preferably joined to the first inner wall surface 11*a* of the housing 10. Although the joining method is not limited to a particular method, diffusion joining or the like can be used, for example. The same applies to the case where the porous body 30 includes the third region 33, and the entire third region 33 is preferably fixed to the first inner wall surface 11*a* of the housing 10. When the porous body 30 is formed from a metal, for example, the entire third region 33 is preferably joined to the first inner wall surface 11*a* of the housing 10.

The first region 31 of the porous body 30 is preferably fixed to the supports 41, 42, 43, and 44. When the porous body 30 is formed from a metal, for example, the first region 31 of the porous body 30 is preferably joined to the supports 41, 42, 43, and 44. Although the joining method is not limited to a particular method, diffusion joining or the like can be used, for example.

As shown in FIG. 3, it is preferable to form the liquid passage 50 also between the second region 32 of the porous body 30 and the support 41 in the cross-section perpendicular to the direction of extension of the porous body 30. Likewise, it is preferable to form the liquid passage 50 also between the second region 32 of the porous body 30 and the support 42. In this case, the working medium 20 can also intrude into an outer side portion of the support 41 or 42, so that the function of the wick in the width direction X can be improved.

An angle formed between the first region 31 and the second region 32 of the porous body 30 (an angle denoted by a in FIG. 3) in the cross-section perpendicular to the direction of extension of the porous body 30 is not limited to a particular value but is preferably greater than 90 degrees. The liquid passage 50 can be formed between the second region 32 of the porous body 30 and the support 41 when the aforementioned angle α is greater than 90 degrees. Moreover, when the first region 31 and the second region 32 of the porous body 30 are formed by the presswork, bent portions are less likely to be damaged by setting the aforementioned angle α greater than 90 degrees. The aforementioned angle α on the support 41 side may be equal to or different from the angle α on the support 42 side. In the meantime, the aforementioned angle α is smaller than 135 degrees, for example.

In the example shown in FIG. 3, each of the first region 31 and the second region 32 of the porous body 30 is straight. Instead, one of them may be straight while the other may be curved, or both of them may be curved.

A material for forming the supports 41, 42, 43, and 44 is not limited to a particular material. Examples of such a material include a resin, a metal, a ceramic, a mixture thereof, a layered body thereof, and the like. Meanwhile, as shown in FIG. 3, the supports 41, 42, 43, and 44 may be integrated with the housing 10, or may be formed by etching the inner wall surface of the first sheet 11 or the second sheet 12.

Figure 6:
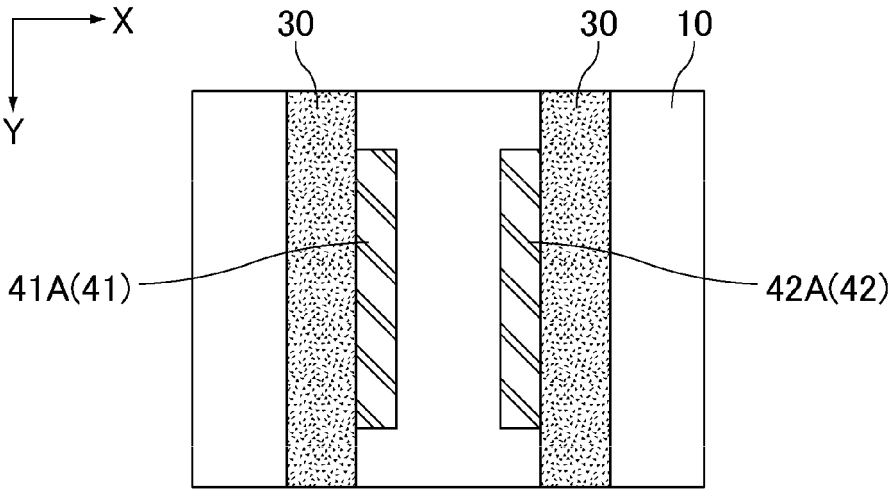
FIG. 6 is a plan view schematically showing an example of supports.
Figure 7:
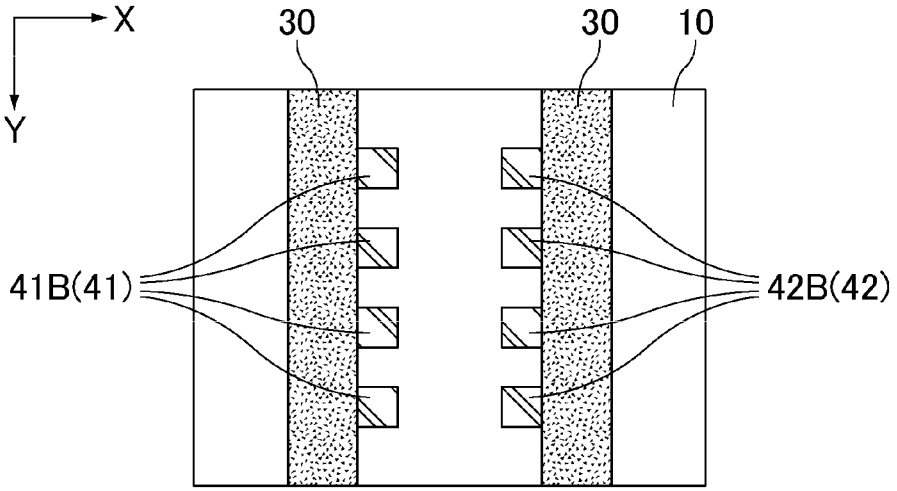
FIG. 7 is a plan view schematically showing another example of the supports.

FIG. 6 is a plan view schematically showing an example of the supports. FIG. 7 is a plan view schematically showing another example of the supports.

In the example shown in FIG. 6, the support 41 is formed from one pillar 41A and the support 42 is formed from one pillar 42A. Although it is not shown in the drawing, each of the supports 43 and 44 is preferably formed from one pillar in this case.

In the example shown in FIG. 7, the support 41 is formed from multiple pillars 41B disposed at intervals and the support 42 is formed from multiple pillars 42B disposed at intervals. Although it is not shown in the drawing, each of the supports 43 and 44 is preferably formed from multiple pillars disposed at intervals in this case.

Shapes of the supports 41 and 42 that support the first inner wall surface 11*a* of the housing 10 and the porous body 30 are not limited to particular shapes as long as such shapes can support the porous body 30. As shown in FIG. 7, the support body is preferably formed from the multiple pillars 41B or 42B disposed at intervals. In this case, the working medium 20 can also introduce into a space between the adjacent pillars 41B or the adjacent pillars 42B, so that the function of the wick in the width direction X can be improved.

Shapes of the supports 43 and 44 that support the second inner wall surface 12*a* of the housing 10 and the porous body 30 are not limited to particular shapes as long as such shapes can support the porous body 30. However, the support body is preferably formed from multiple pillars disposed at intervals. In this case, the vapor can also intrude into a space between the adjacent pillars.

When the support body is formed from the multiple pillars disposed at intervals, examples of a shape of a cross-section of each pillar in a direction perpendicular to a height direction include polygons such as a rectangle, a circle, an ellipse, and the like.

When the support body is formed from the multiple pillars disposed at intervals, heights of the pillars may be equal to or different from one another in one vapor chamber. For example, the heights of the pillars in a certain region may be different from the heights of the pillars in another region.

When the support body is formed from the multiple pillars disposed at intervals, a width of each pillar is not limited to a particular value as long as the width imparts such strength that can support the porous body 30. For example, an equivalent circle diameter of a cross-section at an end portion of the pillar which is perpendicular to the height direction is equal to or above 100 μm and equal to or below 2000 μm, or preferably equal to or above 300 μm and equal to or below 1000 μm.

When the support body is formed from the multiple pillars disposed at intervals, a layout of the pillars is not limited to a particular layout. However, the pillars are preferably disposed evenly in a predetermined region, or more preferably disposed evenly across the board in such a way as to provide constant distances among the pillars, for example.

Second Embodiment

In the first embodiment of the present invention, the vapor passage is formed between the porous body and the second inner wall surface. On the other hand, in a second embodiment of the present invention, the porous body is in contact with the second inner wall surface of the housing.

Figure 8:
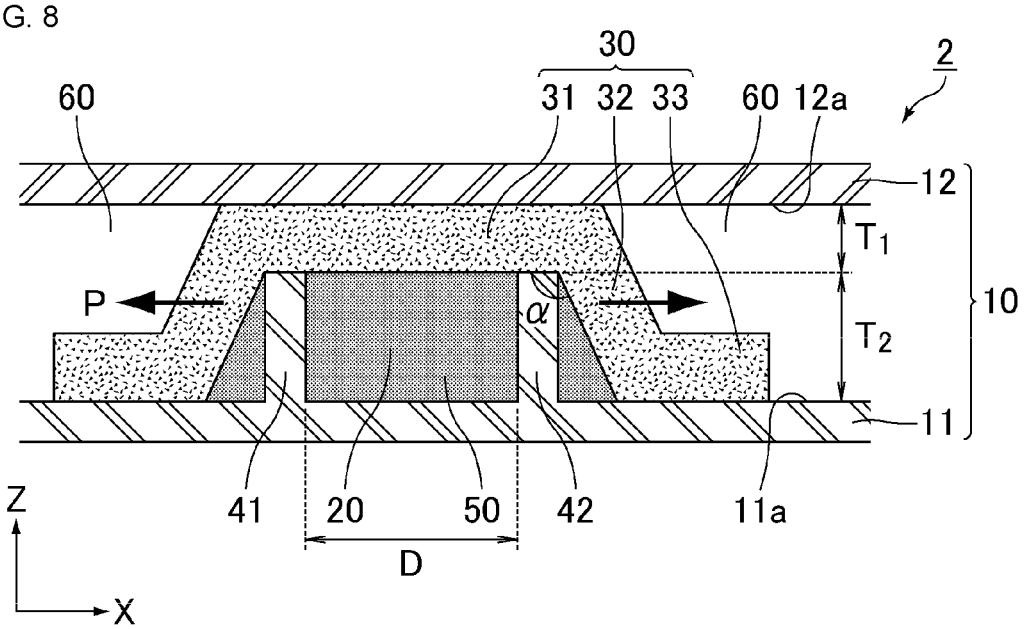
FIG. 8 is a cross-sectional view schematically showing an example of a thermal diffusion device according to a second embodiment of the present invention.

FIG. 8 is a cross-sectional view schematically showing an example of a thermal diffusion device according to the second embodiment of the present invention.

In a vapor chamber 2 shown in FIG. 8, the porous body 30 is in contact with the second inner wall surface 12*a* of the housing 10. When the porous body 30 includes the first region 31 and the second region 32 as shown in FIG. 8, the first region 31 of the porous body 30 is in contact with the second inner wall surface 12*a* of the housing 10. In FIG. 8, directions of the capillary force to be developed by the porous body 30 are indicated with arrows P.

The first region 31 of the porous body 30 is preferably fixed to the second inner wall surface 12*a* of the housing 10. When the porous body 30 is formed from a metal, for example, the first region 31 of the porous body 30 is preferably joined to the second inner wall surface 12*a* of the housing 10. Although the joining method is not limited to a particular method, diffusion joining or the like can be used, for example.

When the thickness of the first region 31 of the porous body 30 is defined as $T_1$ and the height of the support 41 or 42 that supports the first inner wall surface 11*a* of the housing 10 and the porous body 30 is defined as $T_2$ in the cross-section perpendicular to the direction of extension of the porous body 30 as shown in FIG. 8, the ratio $T_2/T_1$ is not limited to a particular value but is preferably equal to or above 1. Meanwhile, the ratio $T_2/T_1$ is equal to or below 4, for example.

The angle $\alpha$ formed between the first region 31 and the second region 32 of the porous body 30 in the cross-section perpendicular to the direction of extension of the porous body 30 is not limited to a particular value but is preferably greater than 90 degrees. Meanwhile, the aforementioned angle $\alpha$ is smaller than 135 degrees, for example.

Other configurations are the same as those of the first embodiment.

Other Embodiments

The thermal diffusion device of the present invention is not limited to the above-described embodiments. Concerning the configuration of the thermal diffusion device, manufacturing conditions thereof, and so forth, various applications and modifications can be added within the scope of the present invention.

Multiple porous bodies may be disposed at the thermal diffusion device of the present invention. In this case, the multiple porous bodies preferably extend in parallel and with intervals therebetween in plan view in the thickness direction.

Figure 9:
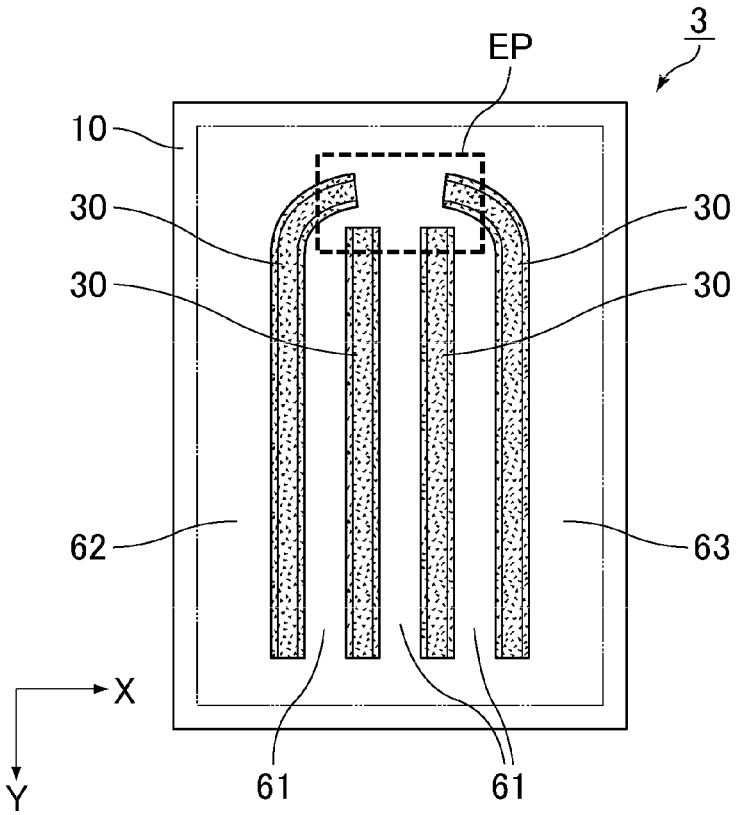
FIG. 9 is a plan view schematically showing an example of an internal structure of the thermal diffusion device in which multiple porous bodies are disposed.

FIG. 9 is a plan view schematically showing an example of an internal structure of the thermal diffusion device in which the multiple porous bodies are disposed.

The multiple porous bodies 30 are disposed at a vapor chamber 3 shown in FIG. 9. Other configurations are the same as those of the vapor chamber 1. Although four porous bodies 30 are shown in FIG. 9, the number of the porous bodies 30 is not limited to a particular number as long as it is equal to or above two.

The multiple porous bodies 30 extend in parallel with intervals therebetween in plan view in the thickness direction Z. As shown in FIG. 9, these porous bodies 30 are preferably disposed in such a way as to converge on the evaporation portion EP. The working medium can be circulated in a shorter distance by causing the porous bodies 30 to converge on the evaporation portion EP.

As shown in FIG. 9 a first vapor passage 61 is preferably formed between every adjacent porous bodies 30. In this case, a second vapor passage 62 having a larger width than that of the first vapor passage 61 is preferably formed between the housing 10 and the porous body 30 located on one of the outermost sides (the porous body 30 on the left side in FIG. 9) among the multiple porous bodies 30. Moreover, a third vapor passage 63 having a larger width than that of the first vapor passage 61 is preferably formed between the housing 10 and the porous body 30 located on the other one of the outermost sides (the porous body 30 on the right side in FIG. 9).

When the multiple porous bodies 30 are unevenly located at a certain portion, the vapor of the working medium does not pass through the certain portion and a uniform heat performance of the vapor chamber as a whole is therefore degraded. Accordingly, the uniform heat performance can be improved by providing clearances between the porous bodies 30 and using the clearances as the vapor passages. A vapor chamber that is excellent in liquid circulation and vapor circulation and has a high liquid transport capacity and a high uniform heat performance is obtained as a consequence.

Materials of the porous bodies 30 may be the same as or different from one another.

Thicknesses of the porous bodies 30 may be equal to or different from one another.

In the thermal diffusion device of the present invention, the housing may include multiple evaporation portions. That is to say, multiple heat sources may be disposed at an outer wall surface of the housing. The numbers of the evaporation portions and the heat sources are not limited to particular numbers.

Figure 10:
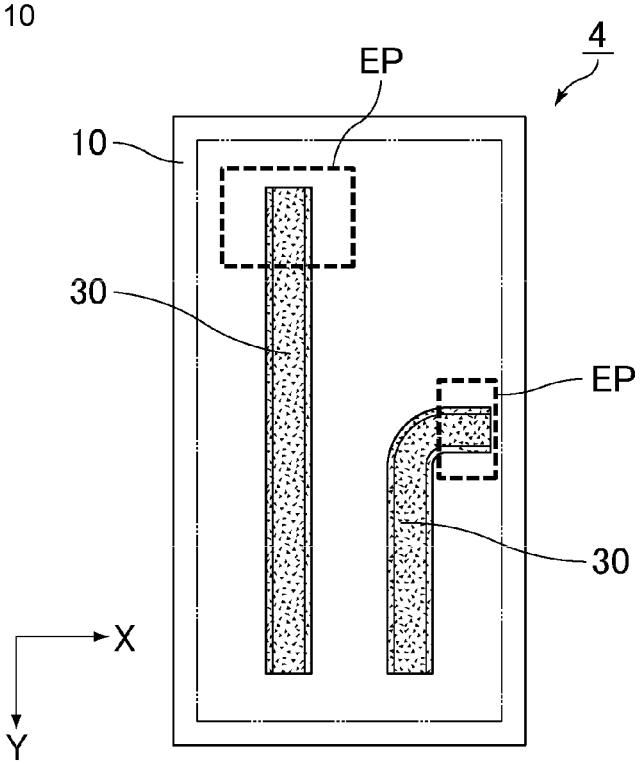
FIG. 10 is a plan view schematically showing an example of an internal structure of the thermal diffusion device in which a housing includes multiple evaporation portions.
Figure 11:
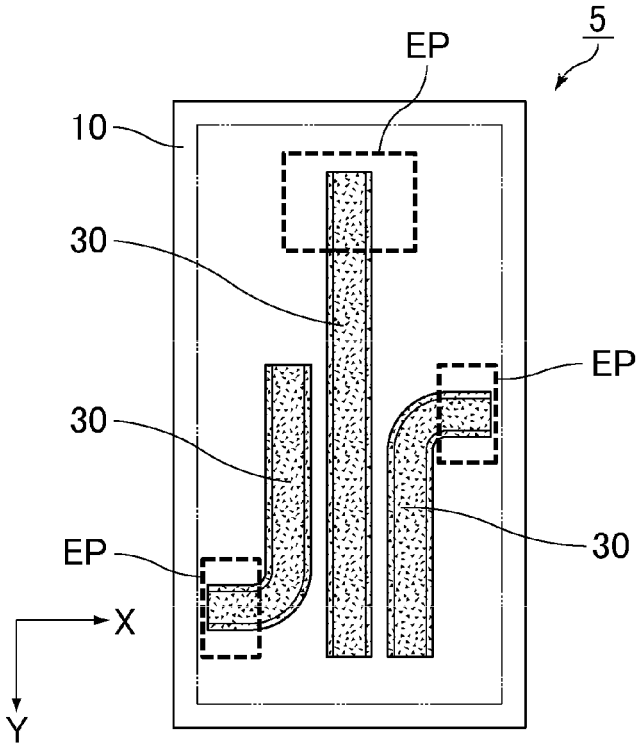
FIG. 11 is a plan view schematically showing another example of the internal structure of the thermal diffusion device in which the housing includes multiple evaporation portions.

FIG. 10 is a plan view schematically showing an example of an internal structure of the thermal diffusion device in which the housing includes multiple evaporation portions. FIG. 11 is a plan view schematically showing another example of the internal structure of the thermal diffusion device in which the housing includes multiple evaporation portions.

Two porous bodies 30 are disposed at a vapor chamber 4 shown in FIG. 10, and evaporation portions EP are provided at end portions of the respective porous bodies 30. Three porous bodies 30 are disposed at a vapor chamber 5 shown in FIG. 11, and evaporation portions EP are provided at end portions of the respective porous bodies 30.

In the thermal diffusion device of the present embodiment, the evaporation portion EP may be provided at an end portion of the housing or provided at a central portion of the housing.

When the housing in the thermal diffusion device of the present invention is formed from the first sheet and the second sheet, the first sheet and the second sheet may be superposed such that end portions thereof coincide with each other, or overlapped such that the end portions are displaced from each other.

When the housing in the thermal diffusion device of the present invention is formed from the first sheet and the second sheet, a material constituting the first sheet may be different from a material constituting the second sheet. For example, it is possible to disperse stress to be applied to the housing by using a high-strength material for the first sheet. In the meantime, by using different materials for the two sheets, one of the sheets can obtain one function while the other sheet can obtain another function. The aforementioned functions are not limited to particular functions. Examples of such functions include a heat transfer function, an electromagnetic wave shielding function, and the like.

In the thermal diffusion device of the present invention, the thickness of the porous body in the cross-section perpendicular to the direction of extension of the porous body may be constant or not constant. For example, the thickness of the porous body in the first region may be different from the thickness of the porous body in the second direction.

The thermal diffusion device of the present invention may further include a wick other than the sheet-like porous body. In this case, the wick is not limited to a particular wick as long as the wick is provided with a capillary structure that can transfer the working medium by using the capillary force. The capillary structure of the wick may have a publicly known structure used in a thermal diffusion device of the related art. Examples of the capillary structure include a microstructure provided with irregularities including pores, grooves, projections, and the like, such as a porous structure, a fibrous structure, a groove structure, and a mesh structure.

The thermal diffusion device of the present invention can be mounted on an electronic apparatus for the purpose of heat dissipation. In this context, an electronic apparatus including the thermal diffusion device of the present invention also constitutes one aspect of the present invention. Examples of the electronic apparatus of the present invention include a smartphone, a tablet terminal, a laptop personal computer, a game device, a wearable device, and the like. As mentioned earlier, the thermal diffusion device of the present invention can operate autonomously without requiring the external drive force, and diffuse the heat two-dimensionally at a high speed by using the latent heat of evaporation and the latent heat of condensation of the working medium. For this reason, the electronic apparatus including the thermal diffusion device of the present invention can effectively achieve heat dissipation in a limited space inside the electronic apparatus.

The thermal diffusion device of the present invention can be used for a wide range of use applications in the field of handheld terminals and the like. For example, the thermal diffusion device can be used for decreasing the temperature of the heat source such as the CPU and for extending operating time of the electronic apparatus. The terminal diffusion device is applicable to a smartphone, a tablet terminal, a laptop personal computer, and the like.

REFERENCE SIGNS LIST

1, 2, 3, 4, 5 vapor chamber (thermal diffusion device)
10 housing
11 first sheet
11*a* first inner wall surface
12 second sheet
12*a* second inner wall surface
20 working medium
30 porous body
31 first region
32 second region
33 third region
41, 42, 43, 44 support
41A, 41B, 42A, 42B pillar
50 liquid passage
60 vapor passage
61 first vapor passage
62 second vapor passage
63 third vapor passage
D interval between supports
EP evaporation portion
HS heat source
$T_1$ thickness of first region of porous body
$T_2$ height of support supporting first inner wall surface of housing and porous body
X width direction
Y length direction
Z thickness direction
$\alpha$ angle formed between first region and second region of porous body

The invention claimed is:

1. A thermal diffusion device comprising:

a housing including a first inner wall surface and a second inner wall surface opposed to each other in a thickness direction of the housing;

a working medium sealed in an internal space of the housing;

a porous body having a sheet-like shape between the first inner wall surface and the second inner wall surface of the housing; and a pillar inside the housing along a direction of extension of the porous body and configured to support the first inner wall surface of the housing and at least a portion of the porous body, the pillar being positioned such that the porous body is between the pillar and the second inner wall surface of the housing and a liquid passage for the working medium is defined in a space surrounded by the porous body and the first inner wall surface, wherein, in a plan view of the housing in the thickness direction, a region where the first inner wall surface overlaps the porous body is smaller than a region where the first inner wall surface does not overlap the porous body, and the porous body includes:

a first region spaced from the first inner wall surface by the pillar; and a second region continuous with the first region, and an end portion of the second region being in contact with the first inner wall surface.

2. The thermal diffusion device according to claim 1, wherein the pillar includes a plurality of pillars arranged in parallel to each other in the direction of extension of the porous body.

3. The thermal diffusion device according to claim 2, wherein the plurality of pillars are disposed at intervals in the direction of extension of the porous body.

4. The thermal diffusion device according to claim 1, wherein the pillar includes a plurality of pillars disposed at intervals in the direction of extension of the porous body.

5. The thermal diffusion device according to claim 1, wherein the liquid passage includes a space between the second region of the porous body and the pillar in a cross-section perpendicular to the direction of extension of the porous body.

6. The thermal diffusion device according to claim 5, wherein an angle between the first region and the second region of the porous body is greater than 90 degrees in the cross-section perpendicular to the direction of extension of the porous body.

7. The thermal diffusion device according to claim 6, wherein the angle is smaller than 135 degrees.

8. The thermal diffusion device according to claim 1, wherein the porous body includes a third region continuous with the second region, the third region being entirely in contact with the first inner wall surface.

9. The thermal diffusion device according to claim 1, wherein the pillar is a first pillar and the thermal diffusion device further comprises:

a second pillar configured to support the second inner wall surface of the housing and the porous body, wherein a vapor passage for the working medium is defined between the first region of the porous body and the second inner wall surface.

10. The thermal diffusion device according to claim 1, wherein the first region of the porous body is in contact with the second inner wall surface of the housing.

11. The thermal diffusion device according to claim 10, wherein, when a thickness of the first region of the porous body is defined as $T_1$ and a height of the pillar that supports the first inner wall surface of the housing and the porous body is defined as $T_2$ in a cross-section perpendicular to the direction of extension of the porous body, a ratio $T_2/T_1$ is equal to or above 1.

12. The thermal diffusion device according to claim 11, wherein the ratio $T_2/T_1$ is equal to or below 4.

13. The thermal diffusion device according to claim 1, wherein, when a thickness of the first region of the porous body is defined as $T_1$ and a height of the pillar that supports the first inner wall surface of the housing and the porous body is defined as $T_2$ in a cross-section perpendicular to the direction of extension of the porous body, a ratio $T_2/T_1$ is equal to or above 1.

14. The thermal diffusion device according to claim 13, wherein the ratio $T_2/T_1$ is equal to or below 4.

15. The thermal diffusion device according to claim 1, wherein the pillar is positioned such that a vapor passage for the working medium is defined between the porous body and the second inner wall surface.

16. The thermal diffusion device according to claim 15, wherein the pillar is a first pillar and the thermal diffusion device further comprises:

a second pillar configured to support the second inner wall surface of the housing and the porous body.

17. The thermal diffusion device according to claim 1, wherein the at least the portion of the porous body is in contact with the second inner wall surface of the housing.

18. An electronic apparatus comprising:

the thermal diffusion device according to claim 1; and a heat generating element in contact with the housing of the thermal diffusion device.

19. An electronic apparatus comprising:

the thermal diffusion device according to claim 1; and an electronic component in contact with the housing of the thermal diffusion device.

* * * * *